United States Patent [19]

Murphy et al.

[11] Patent Number: 5,013,266

[45] Date of Patent: May 7, 1991

[54] TWISTED TERMINAL FOR SWITCHING DEVICE

[75] Inventors: Robert F. Murphy, Nashua, N.H.; Thompson Shek, Newburport, Mass.

[73] Assignee: Augat, Inc., North Andover, Mass.

[21] Appl. No.: 465,924

[22] Filed: Jan. 16, 1990

[51] Int. Cl.[5] ..... H01R 13/415

[52] U.S. Cl. ..... 439/741; 200/284; 200/547

[58] Field of Search ..... 439/741; 200/284, 437, 200/547

[56] References Cited

U.S. PATENT DOCUMENTS 3,284,605 11/1966 Anderson et al. ..... 200/284 X

FOREIGN PATENT DOCUMENTS 1287195 1/1962 France ..... 200/284

2290136 5/1976 France ..... 439/741

863112 3/1961 United Kingdom ..... 200/284

*Primary Examiner*—Eugene F. Desmond

*Attorney, Agent, or Firm*—Pearson & Pearson

[57] ABSTRACT

A terminal structure for an electrical switching device. The terminal structure comprises an integral thin planar member with a external terminal section, a body section, a neck section and an internal contact section all lying along a longitudinal axis. The body section is intermediate the external terminal section and the neck section. The neck section is adjacent the internal contact section that can twist about the neck section to be rotated with respect to the body and external terminal sections. During manufacture, the terminal structure is installed in planar form through a conforming passage in a molded housing. Then the internal contact section is twisted to lock the terminal structure in the housing and to form a seat for a movable contact.

14 Claims, 1 Drawing Sheet

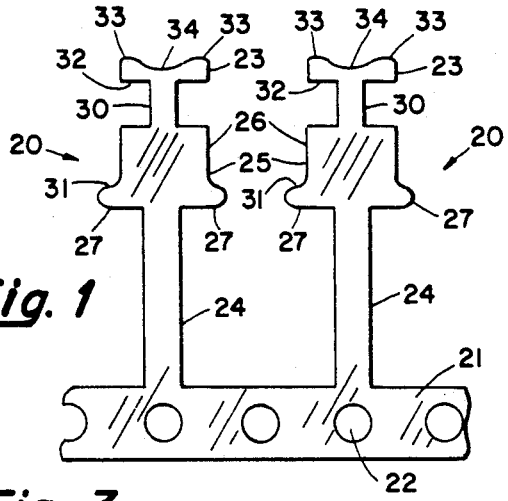
Fig. 1
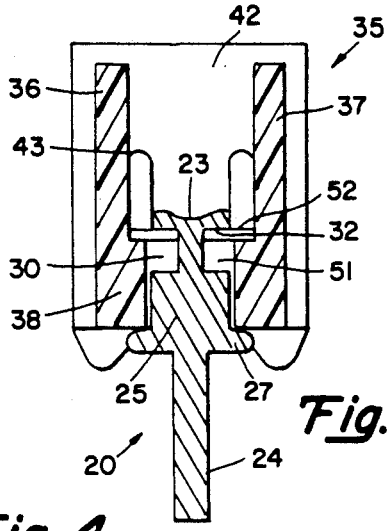
Fig. 2
Fig. 3
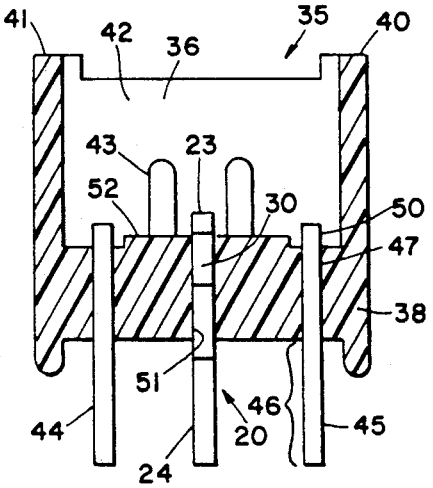
Fig. 4
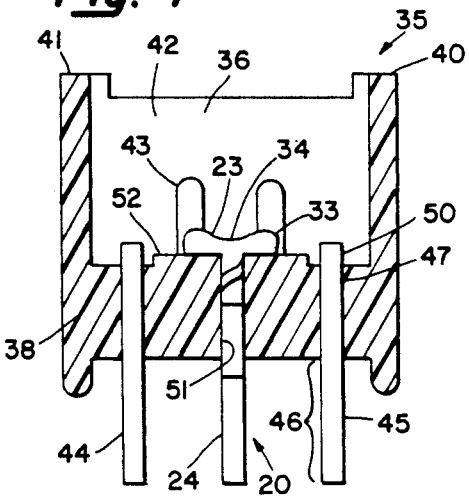
Fig. 5
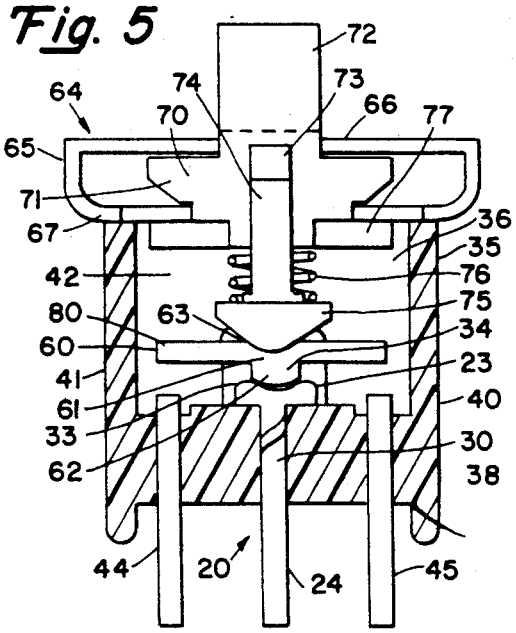
Fig. 6
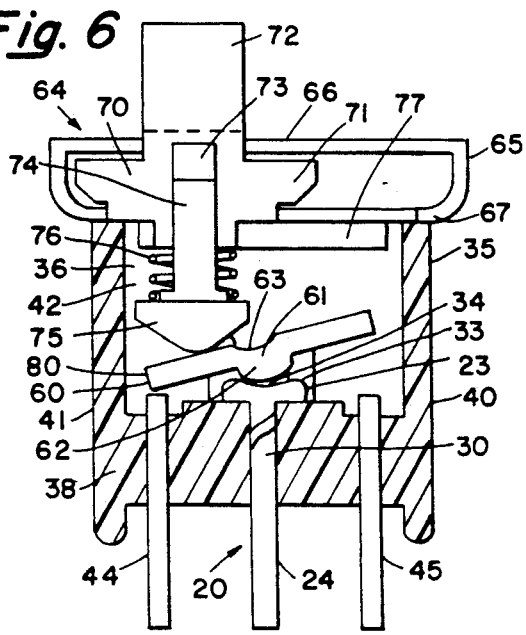

TWISTED TERMINAL FOR SWITCHING DEVICE

BACKGROUND OF THE INVENTION

1. Field of the Invention

This invention generally relates to electrical switching devices and more particularly to a terminal structure that can be used advantageously with such switching devices.

2. Description of Related Art

A number of electrical switching devices comprise two or more terminals for connection in an electrical circuit and a bridging or other movable contact means for making and breaking an electrical connection between the terminals. Actuator means shift the movable contact means between open and closed circuit positions.

As shown in U.S. Pat. No. 30,273 reissued May 13, 1980, such switching devices include a common terminal normally comprising an external terminal mounted to the exterior of a housing and a U-shaped internal contact on the inside of the housing. A rivet extends through the housing and clamps the external terminal and internal central contact together A bridging contact pivots about the U-shaped central contact under the influence of an actuator. In this particular patent the actuator means comprises a rocker actuator that rotates about a pivot pin and that contains a spring mounted plunger for allowing the bridging contact to spring to an open position in one orientation of the rocker and to overcome the spring bias and close the contact in another position of the rocker.

In this and other similar switch configurations, this common terminal structure comprises three discrete pieces, namely: an external terminal, an internal contact and a rivet. Further the internal contact extends along an axis that is transverse to the plane of travel for the actuator means. It becomes difficult and tedious to assemble this contact, particularly if component orientation is critical. A switch housing may require special molded recesses for aligning the internal contact and external terminal properly during a riveting operation. In smaller switches, the entire riveting operation can become difficult even without a component alignment requirement.

It also has been proposed to combine two of the three components in a subassembly. For example, in some switching devices the external terminal and a rivet or stud become a subassembly that is inserted into the switch housing. The internal contact is positioned over an extension of the rivet or stud inside the housing. A riveting or corresponding peening operation then drives the rivet or stud onto the internal contact to complete the operation. However, the number of operations are essentially the same as required with three discrete components. Moreover, it is still difficult to locate the external terminal and the internal contact during a peening or riveting operation.

SUMMARY

Therefore it is an object of this invention to provide a structure for an external terminal and internal contact that facilitates the manufacture of switching devices with movable contacts and the like.

Another object is to form an external terminal and internal contact as an integral structure that can be firmly fixed to a housing.

In accordance with this invention, a terminal structure comprises a stamping of a planar conductive material. The stamping has an external terminal section, an intermediate body portion adjacent the external terminal section, a neck section adjacent the internal body section and an internal section attached to the neck section all lying along a longitudinal axis. The terminal structure lies in a corresponding aperture in a molded base. The internal contact section is rotated thereby twisting the material through the neck section and clamping the integral assembly against the molded base to provide a conductive path through the insulated housing.

BRIEF DESCRIPTION OF THE DRAWINGS

This invention is pointed out with particularity in the appended claims. The various objects, advantages and novel features of this invention will be more fully apparent from a reading of the following detailed description in conjunction with the accompanying drawings in which like reference numerals refer to like parts, and in which:

FIG. 1 is a plan view of a portion of a stamped terminal structure constructed in accordance with this invention;

FIG. 2 is a view of a molded base after the terminal structure of FIG. 1 is positioned initially;

FIG. 3 is another view of the terminal structure in the molded base shown in FIG. 2;

FIG. 4 is a view corresponding to FIG. 3 after the terminal structure is locked into position;

FIG. 5 is a view of a switch embodying this invention in one operating position; and FIG. 6 is a view of the switch shown in FIG. 5 in another operating position.

DESCRIPTION OF ILLUSTRATIVE EMBODIMENTS

FIG. 1 is a plan view of two terminal structures 20 that embody this invention. Conventional stamping techniques produce the terminal structures 20 from thin conductive material. The terminal structures 20 cantilever from a web 21 with a plurality of pin feed holes 22 that are useful in feeding successive terminal structures 20 during manufacture. Other conventional means sever individual terminal structures 20 from the web 21.

Each terminal structure 20 comprises a plurality of interconnected sections including an internal contact section 23 and a spaced external terminal section 24. An intermediate body section 25 is adjacent the external terminal section 24 and has a rectangular portion 26 and ears 27 that are transverse to a central longitudinal axis, that is a vertical axis, through the terminal structure 20 in FIG. 1. A neck section 30 of reduced width that extends along the axis interconnects the internal contact structure 23 and the body section 25 Typically the neck section 30 has a width of about 25% of the width of the rectangular portion 26 and a length about two times its width. The spacing between the internal contact structure 23 and the ears 27 is defined by an upper edge 31 of an ear 27 and a lower edge 32 of the internal contact section 23. The distance between the edges 31 and 32 corresponds to a predetermined molded base thickness as described later. The internal contact section 23 comprises two spaced horns 33 on either side of a concave section 34 such that the upper edge of the internal contact section 23 has a saddle shape.

When the terminals 20 shown in FIG. 1 are detached from the web 21 they are inserted in a molded housing 35 shown in FIGS. 2 through 6. Referring specifically to FIGS. 2 and 3, the housing 35 has side walls 36 and 37, base 38 and interconnecting end walls 40 and 41. The walls 36, 37, 40 and 41 and the base 38 define an open switching cavity 42 that receives the switching mechanism.

Still referring to FIGS. 2 and 3, the housing 35 has a plurality of vertical passages through the base 38. Two outer passages receive terminal structures 44 and 45. Referring particularly to terminal structure 45, an external terminal section 46 extends below the base 38. A body portion 47 is coextensive with the base 38 and an internal contact portion 50 extends above the base 38 into the cavity 40. Conventional techniques secure these terminal structures in the molded base 38.

The base 38 also contains a central passage 51 that receives the terminal structure 20 from the exterior of the molded housing 35. As the terminal structure 20 moves into the passage 51 with the internal contact section 23 first, the edges 31 on the ears 27 eventually abut the bottom surface of the base 38. In this position the base 38 captures the body section 25 in the passage to prevent any rotation of the body section 25. Moreover, the internal contact section 23 lies above the upper surface of the base 38, this surface constituting a floor 52 of the cavity.

If the internal contact structure 23 now is twisted 90° counter-clockwise from the top viewing down into the cavity 40, the relative dimensions of the neck 30, the contact structure 23 and the body 25 permit the neck 30 to twist relative to the floor 52 and the body section 25. The internal contact structure 23 moves from the position shown in FIG. 3 to the position shown in FIG. 4. Now the bottom edge 32 engages the cavity floor 52. The terminal structure 20 can not be removed from the base 38. Moreover, during the twisting operation, the effective length of the neck 30 tends to shorten, so a clamping force exists between the edges 31 and 32. Therefore, the terminal structure 20 clamps itself in the base 38 and is fixed in position.

As will be apparent, this terminal structure is readily adapted to manufacturing operations. The single structure replaces the two-piece and three-piece component structures of the prior art and eliminates alignment and riveting or peening operations.

Referring to FIGS. 5 and 6, where like reference numerals designate components that are identical to those shown in FIGS. 1 through 4, the housing 40 with the terminal structures 20, 44 and 45 constitutes a initial subassembly. In the specific embodiment of FIGS. 5 and 6 the switching device is a single-pole, double throw switch with normally open contacts and a center off position. FIG. 5 depicts the switching device in the center off position; FIG. 6, with a movable contact making a circuit between the terminal structure 20 and the terminal structure 44.

The switching components include a movable contact in the form of a bridging contact 60 that has two extensions from a central U-shaped portion 61 characterized by a lower convex surface 62 and an upper concave surface 63. A top closure 64 covers the cavity 40 and includes a frame structure 65 with a top frame member 66 and a spaced, parallel bottom frame member 67. The frame members 66 and 67 capture a slider 70 for horizontal motion to activate the switch.

The slider 70 has a base 71 and an operator 72 that extends through a slot in the top frame member 66, so the slider can move from the center position in FIG. 5 to either of the end positions, such as the left end position in FIG. 6. A vertical cavity 73 in the actuator 72 carries a plunger 74 with a conical head 75 and a concentric spring 76 that biases the head 75 downwardly against the bridging contact 60. The actuator 72 may also have horizontally extending tabs (not shown) that ride in slots 77 between the top edge of the side walls 36 and 37 and the frame member 64 thereby to enable a smooth horizontal motion.

In the position shown in FIG. 5, the conical head 75 presses against the concave surface 63 of the bridging contact 60. The convex surface 62 lies between the horns 33 of the internal contact structure 23. The resulting forces keep the bridging contact 60 in a horizontal orientation that constitutes the center off position. As the operator 72 moves to the left to the position shown in FIG. 6, an initial displacement causes the head 75 to retract against the bias of the spring 76 and begin to pivot a left end 80 about the internal contact section 23. After some additional displacement the forces exerted by the plunger 74 and head 75 move the bridging contact 60 to abut the terminal structure 44 and simultaneously move the plunger 74 and the slider 70 to the left until the slider 70 abuts the frame 65.

Thus, the actuator acts as a detent and produces a detent action when the switch turns on. When the slider 70 moves toward the center position, the mechanism again produces a distinct detent action as the conical head 75 snaps against the concave surface 63 of the bridging contact 60. A similar detent action occurs when the slider moves to the right from the position shown in FIG. 5 to connect the terminal structures 20 and 45.

In summary, there is disclosed a terminal structure for electrical switching devices that is simple to implement and assemble into a switching device. The common terminal structure has a thin planar construction with an external terminal section, and an intermediate body section between the external terminal section and a neck section. The neck section supports an internal contact section. When this planar structure is inserted into a housing through a conforming passage, the internal contact section can be twisted to lock the terminal structure in place and to form a pivot for a movable contact. Switching devices incorporating this terminal structure are easy to manufacture. Moreover, the mechanism is easily adopted to produce a detent action that is highly desirable as an actuator moves between the various "on" and "off" positions of such switching devices.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A terminal structure for an electrical switching device having a housing with an internal switching cavity comprising, as an integral terminal structure, a planar conductive member having, at locations along a longitudinal axis and at opposite ends of said conductive member, an internal contact section for being positioned inside the cavity and an external terminal section for being positioned external to the housing, said conductive member additionally comparing a body section along the longitudinal axis adjacent said external terminal section and a neck section of reduced width that extends along the longitudinal axis intermediate said body and internal contact sections, said body section being adapted for capture in the electrical switching device housing thereby to prevent rotation of said body section about the longitudinal axis and said neck section enabling said internal contact section to be twisted about the longitudinal axis inside the cavity with respect to said body section thereby to enable said internal contact section to engage the housing inside the cavity and to capture said conductive member longitudinally in said housing.

2. A terminal structure as recited in claim 1 wherein said internal contact section has a portion for engaging the electrical switching device for limiting motion of said terminal structure along the longitudinal axis in one direction.

3. A terminal structure as recited in claim 2 wherein said body section has a first portion for engaging the electrical switch device thereby to prevent the rotation thereof about the longitudinal axis and a second portion for engaging the electrical switching device for limiting motion of said terminal structure along the longitudinal axis in the other direction.

4. A terminal structure as recited in claim 2 wherein the electrical device includes a movable contact with pivot means about which the movable contact can pivot and said internal contact section further includes contact engagement means for engaging the movable contact pivot means.

5. A terminal structure as recited in claim 4 wherein the movable contact includes a pivot portion and said contact engagement means includes upstanding end portions and a depressed central portion for receiving the movable contact pivot.

6. A terminal structure as recited in claim 1 wherein said neck section has a dimension transverse to the longitudinal axis that is about 25% of the corresponding dimensions of said body and internal contact sections and has a length along the axis of about two times its width.

7. A terminal structure as recited in claim 1 wherein said terminal structure comprises a stamping from a planar conductive material.

8. In an electrical switching device having a housing with a switching cavity therein, first and second terminal means affixed to said housing, movable contact means supported in said cavity for selectively bridging said first and second terminal means and actuator means for moving said movable contact means between conductive and nonconductive position, the improvement of said first terminal means formed as an integral planar conductive member having at locations along a longitudinal axis and at opposite ends of said conductive member an internal contact section within said switching cavity and an external terminal section external to said switching cavity, a body section on the longitudinal axis and adjacent said external terminal section and a neck section of reduced width that extends along the longitudinal axis intermediate said body and internal contact sections, said housing having a passage conforming to said body section thereby to prevent rotation of said body section about the longitudinal axis and said neck section enabling said internal contact section to be twisted about the longitudinal axis inside the cavity with respect to said body section and to said passage through the housing thereby to enable said internal contact section to engage the housing inside the cavity and to capture said conductive member longitudinally in the housing.

9. An electrical switching device as recited in claim 8 wherein said internal contact section includes means for engaging said housing inside said switching cavity thereby to limit motion of said terminal structure along the longitudinal axis to the exterior of said housing.

10. An electrical switching device as recited in claim 9 wherein said body section has a first portion for engagement by said switch housing for preventing rotation thereof about the longitudinal axis and a second portion for engaging an exterior surface of said housing thereby to limit motion of said terminal structure along the longitudinal axis into said switching cavity.

11. An electrical switching device as recited in claim 9 wherein said movable contact means has a predetermined configuration and a pivot means about which said movable contact can pivot and said internal contact section includes means with a profile corresponding to said movable contact means configuration for engaging and seating said movable contact pivot means.

12. An electrical switching device as recited in claim 11 wherein said movable contact includes a pivot with a convex section and said contact engagement means includes upstanding end portions and a depressed central portion for receiving said convex section.

13. An electrical switching device as recited in claim 8 wherein said neck section has a dimension transverse to the longitudinal axis that is about 25% of the corresponding dimensions of said body and internal contact sections and has a length that is about two times its width.

14. An electrical switching device as recited in claim 8 wherein said terminal structure comprises a stamping from a planar conductive material, certain of said sections being plated.

* * * * *